US005137114A

United States Patent [19]

Yde et al.

[11] Patent Number: 5,137,114

[45] Date of Patent: Aug. 11, 1992

[54] STAIR TRACK DEVICE

[75] Inventors: Frederick R. Yde, Carmel; Martin R. Albar, Indianapolis, both of Ind.

[73] Assignee: The Moving Company, Carmel, Ind.

[21] Appl. No.: 783,358

[22] Filed: Oct. 28, 1991

[51] Int. Cl.[5] ..... E01D 1/00; E04F 11/00

[52] U.S. Cl. ..... 182/49; 182/129; 14/71.1

[58] Field of Search ..... 182/49, 48, 129; 14/69.5, 71.1

[56] References Cited

U.S. PATENT DOCUMENTS

| | | | |
|---|---|---|---|
| 981,613 | 1/1911 | Carter . | |
| 1,506,116 | 8/1924 | Fenn . | |
| 2,312,273 | 2/1943 | Stochmal . | |
| 3,009,183 | 11/1961 | Lay . | |
| 3,063,513 | 11/1962 | Marryatt | 182/49 |
| 4,528,711 | 7/1985 | Packer . | |
| 4,628,561 | 12/1986 | Kushniryk | 14/71.1 |
| 4,712,264 | 12/1987 | Voith . | |
| 4,943,048 | 7/1990 | Hentges | 182/49 |
| 5,077,852 | 1/1992 | Karlsson | 14/69.5 |

*Primary Examiner*—Reinaldo P. Machado
*Attorney, Agent, or Firm*—Woodard, Emhardt, Naughton, Moriarty & McNett

[57] ABSTRACT

A stair track device adjustable to correspond with a variety of physically different stairways is shown. The stair track device includes right side rails which slidably engage one another in telescopic fashion to form a rail assembly. Locking pins fix the telescopic position of the rails with respect to one another. A corresponding mirror image left rail assembly is secured in position with respect to the right rail assembly by way of rods removably attached to each rail assembly. Lower and upper support members provide anti-skid support as well as establishing a proper angular relationship between the rail assemblies and the stairway. The rails can be detached from one another collapsed and compactly stored for easy transport to any location.

20 Claims, 6 Drawing Sheets

STAIR TRACK DEVICE

BACKGROUND OF THE INVENTION

1. Field of the Invention

This invention relates to stairway ramps and the like used to provide a transfer structure for wheeled dollies or wheelchairs thereby enabling access to two areas of unequal height connected by a stairway.

2. Description of the Prior Art

Prior art devices have relied on a number of different designs. In U.S. Pat. No. 4,528,711 to Packer, a vehicle wheelchair ramp is disclosed having a pair of ramps telescopically engaging one another that are U-shaped in cross section. A pair of transversely positioned elongated spacer brackets are attached to the ramps to provide uniform transverse spacing of the ramps. The ramps can be detached from one another, collapsed and secured together for ease of transport.

An alternate approach in providing a stairway ramp is disclosed in U.S. Pat. No. 4,712,264 to Voith. The Voith ramp is constructed from a plurality of right triangular modules which nest in the recesses of a stairway. The modules are securely and releasably interconnected by tethered locking pins received by registering locking apertures of male and female connector elements. A continuous stairway ramp formed by two parallel groups of modules is laterally adjustable through connector slides on the riser walls of the modules.

Other stairway ramp devices are disclosed in the following patents: U.S. Pat. No. 981,613 to Carter; U.S. Pat. No. 1,506,116 to Wiebe; U.S. Pat. No. 2,312,273 to Stochmal; and U.S. Pat. No. 3,009,183 to Lay. The prior art devices are limited in several respects with regard to ease of portability, dismantling and reassembly, adjustability to accommodate varying stairway inclination angles as well as length of stairways, and cost of manufacture. A new stair track apparatus having greater flexibility to accommodate a wide variety of stairways having diverse dimensions is needed.

SUMMARY OF THE INVENTION

A stair track device for use with a stairway according to the present invention comprises, a first rail having an L-shaped cross-section, said first rail including a channel on one surface of said first rail and a tongue means on a second surface of said first rail for slidably engaging a corresponding mating channel of another rail, a second rail having an L-shaped cross-section, said second rail including a channel on one surface of said first rail and a tongue means on a second surface of said first rail wherein said second rail slidably engages said channel of said first rail to provide a first longitudinally adjustable rail assembly, a third rail having an L-shaped cross-section, said third rail including a channel on one surface of said first rail and a tongue means on a second surface of said first rail for slidably engaging a corresponding mating channel of another rail, a fourth rail having an L-shaped cross-section, said fourth rail including a channel on one surface of said first rail and a tongue means on a second surface of said first rail wherein said fourth rail slidably engages said channel of said third rail to provide a second longitudinally adjustable rail assembly, a first triangular support member removably attached to said first rail, said first support member situated near the top of the stairway, a second triangular support member removably attached to said third rail, said second support member situated near the top of the stairway, anda first transverse stabilizer rod removably attached to said first and second triangular support members, said rod situated in close proximity to the surface of the stairway.

One object of the present invention is to provide an improved stair track device.

Another object of the present invention is to provide a stair track device having increased flexibility for installation on diversely dimensioned stairways.

Another object of the present invention is to provide a stair track device which may be situated on a variety of stairways having varying dimensions, yet allows normal traversing of the stairway.

Yet another object of the present invention is to provide a stair track device which is modular in design for ease of disassembly and storage yet relatively inexpensive to manufacture.

These and other objects of the present invention will become more apparent from the following description of the preferred embodiment.

DESCRIPTION OF THE PREFERRED EMBODIMENT

Figure 1:
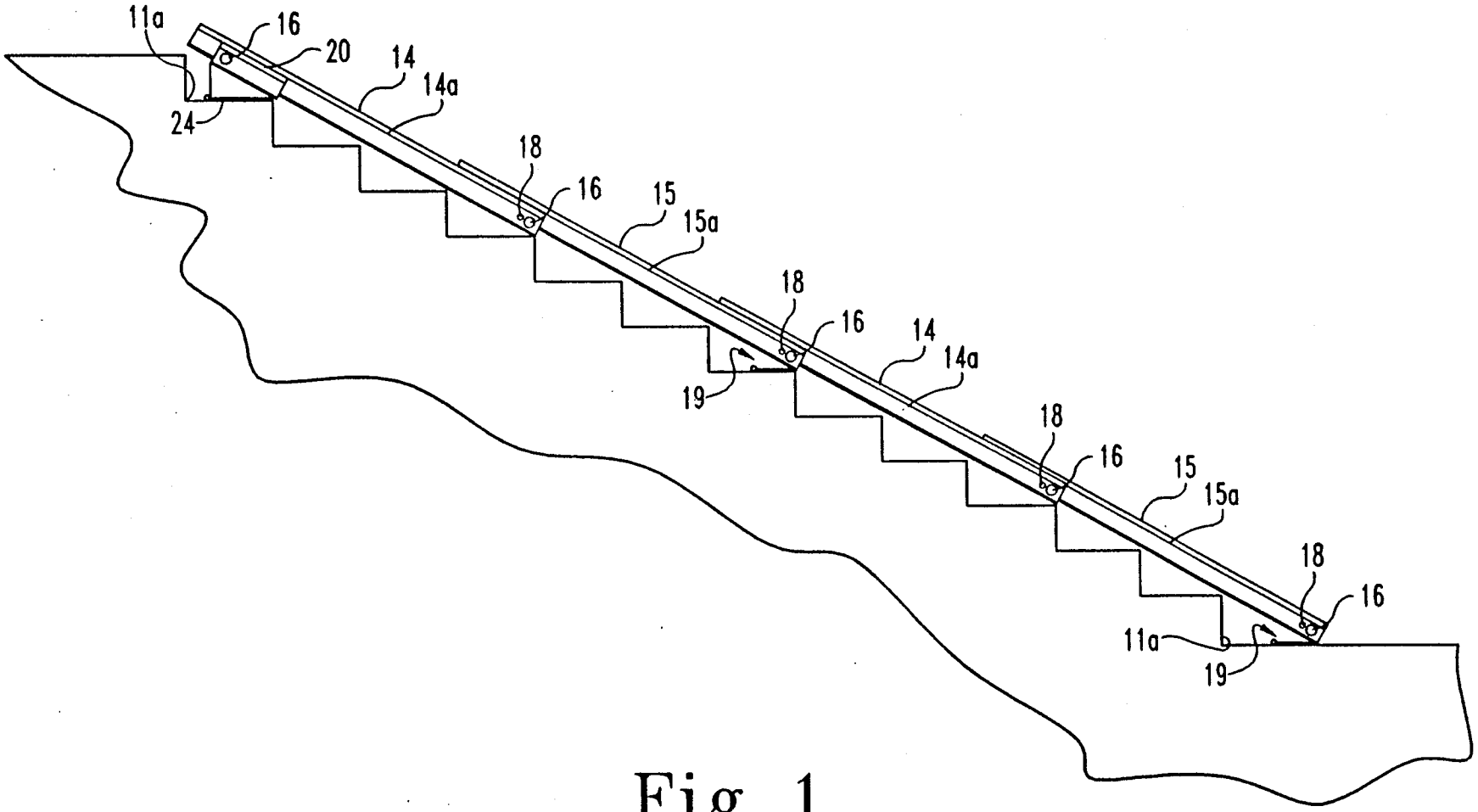
FIG. 1 is a side view of a stair track device according to the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1A:
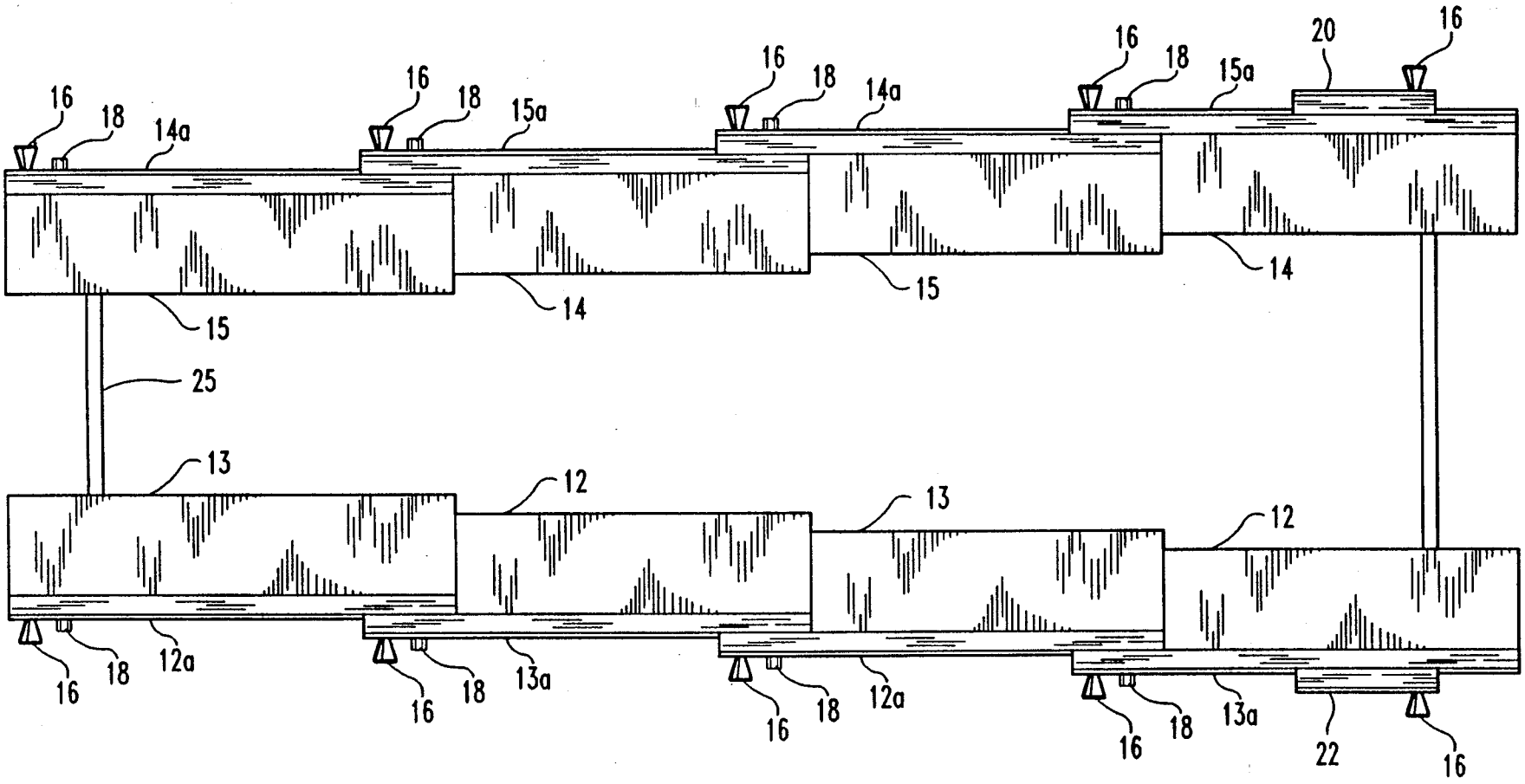
FIG. 1A is a plan view of the stair track device according to the present invention.

Referring now to FIGS. 1 and 1A, a side elevational view and a plan view of the stair track device 10 according to the present invention are respectively shown. Component parts of the stair track device 10 include a right rail 12, a right rail 13, a left rail 14 and a left rail 15. Rails 12 and 13 include means for slidably engaging adjacent rails to form a telescoping rail assembly. Rails 14 and 15 also include means for slidably engaging adjacent rails to form a telescoping rail assembly. Thus, the two rail assemblies (each assembly comprised of at least two rails telescopically and slidably attached to one another) are longitudinally extendable to conform in length with various length stairways 11.

Figure 3:
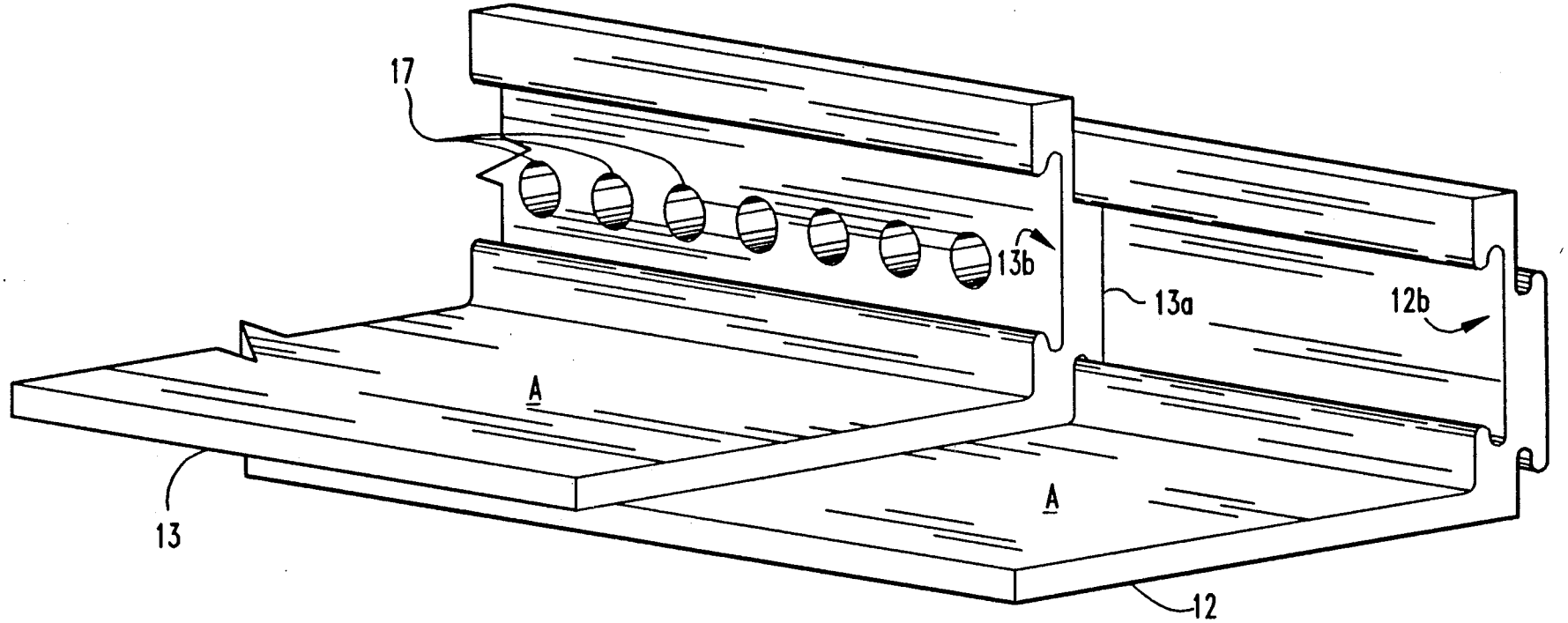
FIG. 3 is a partial view of the stair track rails of the present invention detailing the mating of two adjacent rails via the tongue and groove of each rail.
Figure 6:
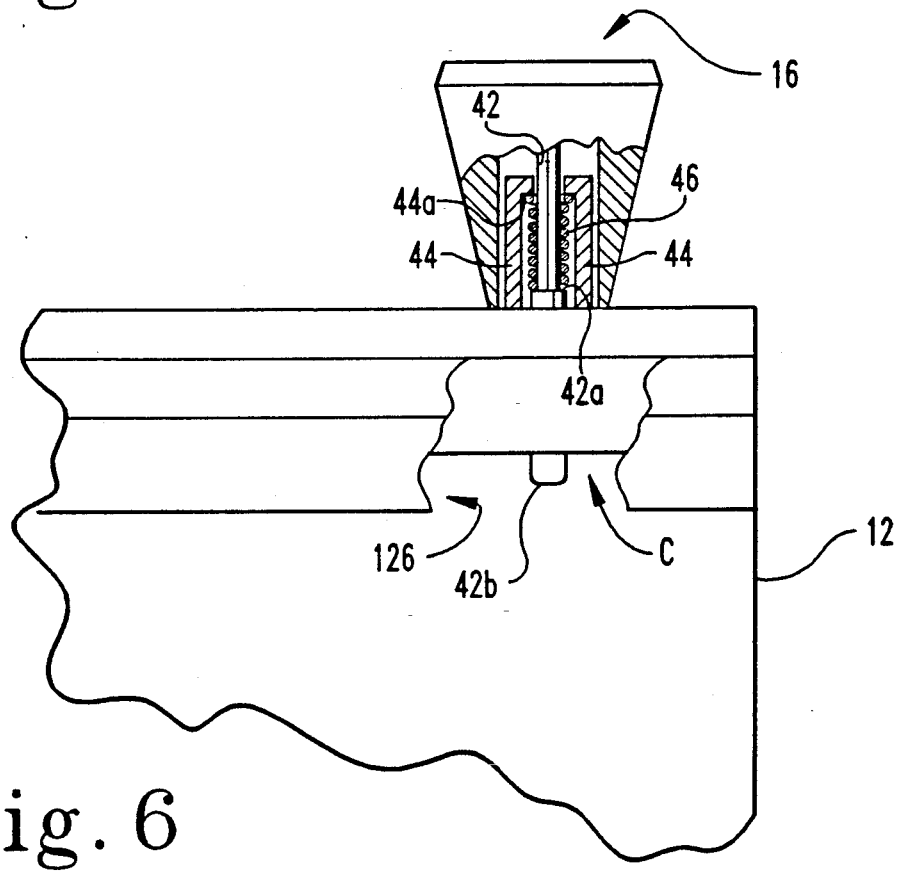
FIG. 6 is a partial cutaway view of the locking pin mechanism of the present invention.

When the rails 12, 13, 14 and 15 are longitudinally extended to an appropriate length, locking pin 16 is actuated so as to fix the longitudinal position of the slidably attached adjacent rails, one with respect to the other, to prevent further longitudinal movement of the rails and lock the rails in a predetermined position. Further detail regarding the locking pin 16 and mating holes (item 17 in FIG. 3) in which the locking pin is inserted are shown in FIGS. 6 and 3, respectively. Stop pins 18 limit the sliding movement of engaged adjacent rails and protect locking pin 16 from damage when the rails are longitudinally or telescopically positioned at a minimum length position for movement or storage of the stair track device 10. Stop pins 18 are bolts in the preferred embodiment.

Figure 5:
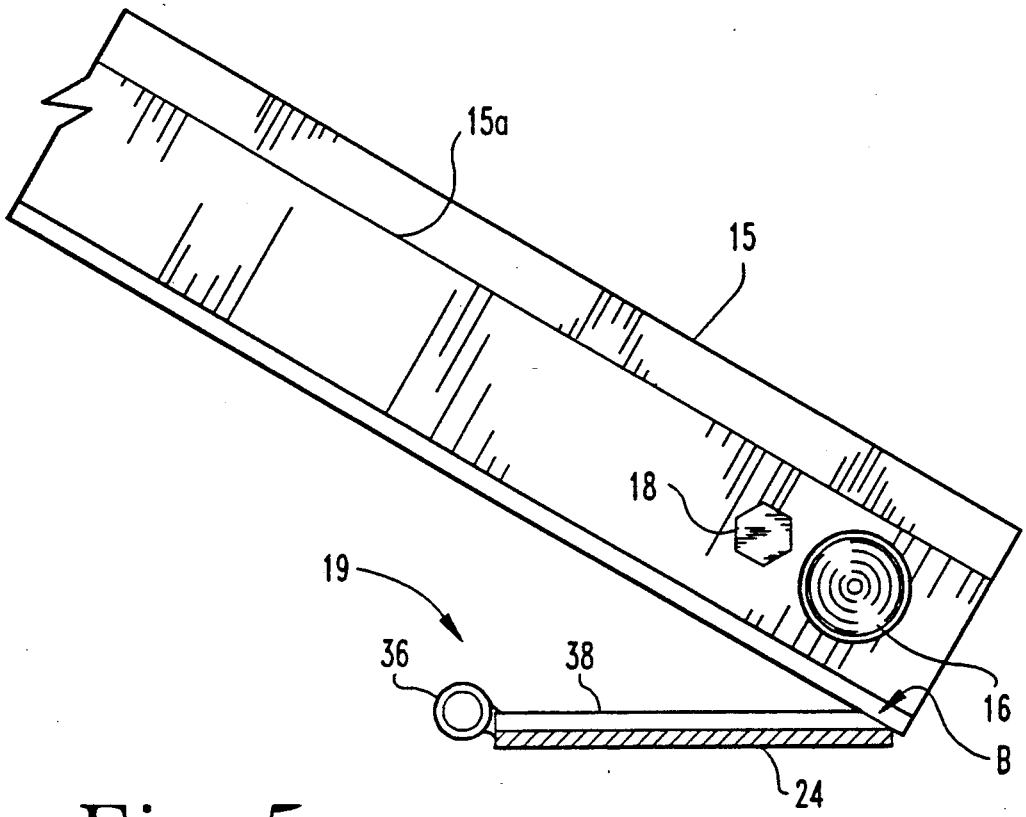
FIG. 5 is a partial side view of the lower rails of the stair track device illustrating the lower support member and the anti-skid pad attached thereto.

Each of the rails 12–15 includes a corresponding tongue **12*a*–15*a* which engages a channel or retaining groove in an adjacent rail to enable telescopic adjustment of the rails with respect to one another. Lower support members 19 are welded or fixedly attached to rails 13 and 15 at the lower end to provide a lower support base. Further detail regarding the lower support member 19 is shown in FIG. 5**.

Triangular supports 20 and 22 are positioned near the top of the stairway on the first step below the top of the stairway to provide an upper support mechanism to maintain the stair track device 10 in a proper attitude or angular relationship with the stairway 11. Both triangular supports 20 and 22 include anti-skid pads 24 and locking pins 16 to secure the rails 12 and 14 to the corresponding triangular supports 22 and 20, respectively. Finally, rods 25 establish a predetermined fixed distance between the opposing rails. Rods 25 are removably attached to the triangular supports 20 and 22 and to the lower support members 19 by way of well known mechanical attachment mechanisms such as tubes and cotter pins.

The stair track device 10 is configurable by way of deleting or adding additional rails 12 through 15 to accommodate or adjust to any size stairway. For example, if the stairway is relatively short in length, i.e. five steps or less, then a stair track device requiring only one set of rails 12 through 15 would be required, rather than two full complement sets of rails 12 through 15. Since the triangular supports 20 and 22 are removably installable on any of the rails 12 through 15, the upper support mechanisms (the supports 20 and 22) are slidably positioned on any rail to conform with the length of a particular stairway. In addition, the locking pins 16 enable an exact telescopic adjustment of the rail assembly comprised of rails 14 and 15 as well as the rail assembly comprised of rails 12 and 13 to enable longitudinal adjustment of the stair track device 10 to fit the length of most any stairway.

Figure 2:
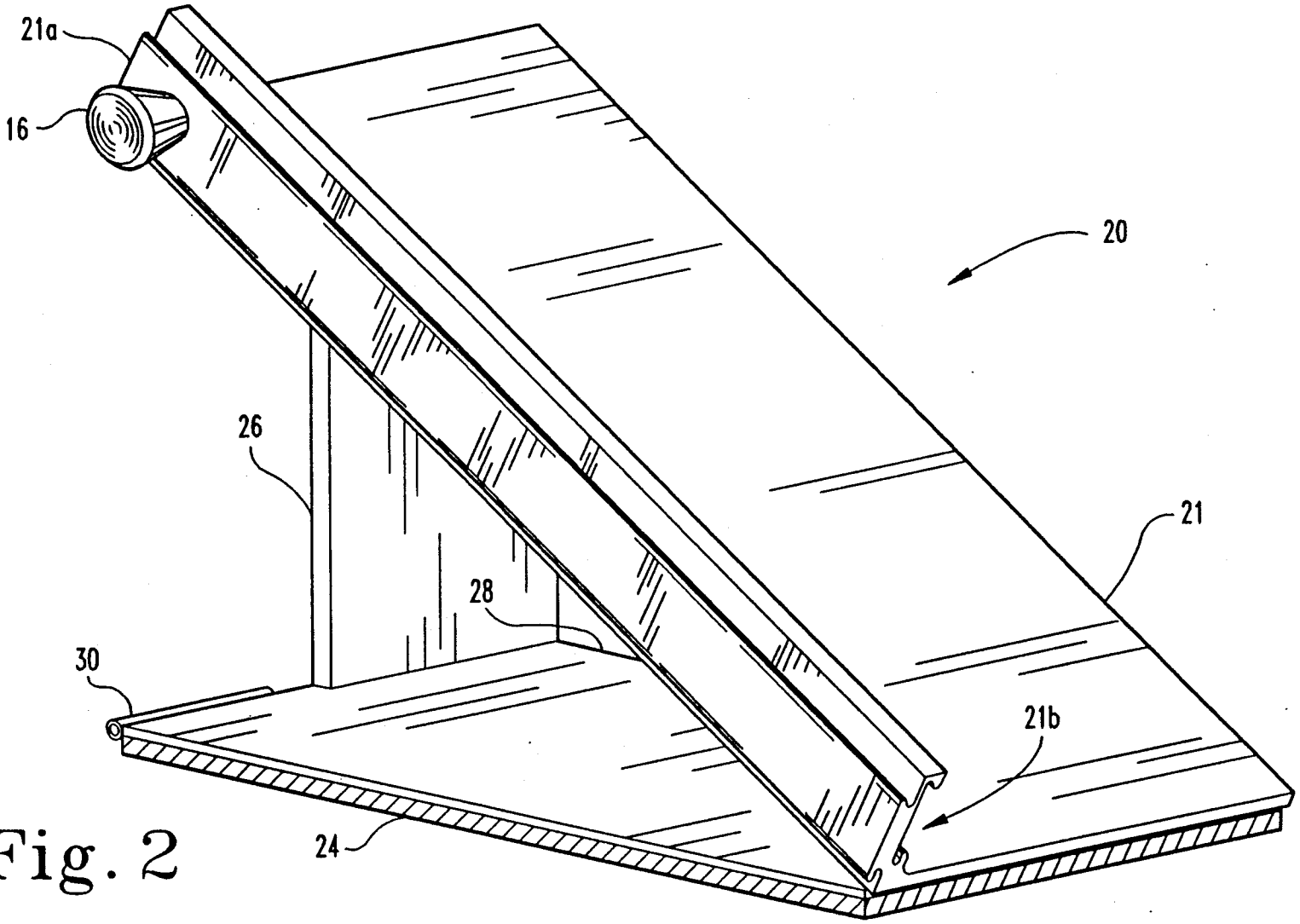
FIG. 2 is a perspective view of the stair track support of FIG. 1.

Referring now to FIG. 2, a perspective view of the triangular support 20 is depicted. The triangular support 20 is comprised of a section of rail 21 which is identical in cross section with rail 14. The rail section 21 includes a tongue **21*a* and a retaining groove 21*b*. The tongue 21*a* is sized so that it is slidably receivable in the retaining groove of rails 14 and 15. Likewise, groove 21*b* is sized to slidably receive the tongue of rails 14 and 15. Locking pin 16 is also shown. Anti-skid pad 24 is attached to the underside of the triangular support 20 and prevents grooves of rails 12–15 slipping or movement of the support 20 and the stair track device 10 with respect to the stairway 11. Vertical support brace 26 maintains a predetermined angular relationship between rail 21 and bottom plate 28. Tube 30 is attached to bottom plate 28 and receives rod 25 to establish a predetermined fixed distance between the triangular supports 20 and 24**.

The rails 12 through 15, the lower support members 19, and the component parts of the triangular supports 20 and 22 can be made of any structurally high strength material. Steel, aluminum, titanium, or high strength polymers such as graphite impregnated polymers may be used as base materials for constructing the stair track device 10. The anti-skid pads 24 are typically a rubber type material and are attached using adhesives (or other suitable mechanical fasteners) to the underside of the support members 19 and bottom plates 28. Various well known techniques are contemplated for manufacturing the component parts of the stair track device 10. More specifically, welding, gluing, adhesive bonding, etc. are contemplated. The rails 12 through 15 may be manufactured using well known techniques such as machining, extruding, casting, molding, etc.

The triangular support 22 is a mirror image of triangular support 20 and is identical in all respects therewith. Therefore, all details regarding triangular support 22 should be apparent from the description of triangular support 20.

Referring now to FIG. 3, the slide mechanism of rails 12 and 13 is shown in more detail. The cross-section of rails 12 and 13 are designed so that tongue **13*a* slidably engages channel or retaining groove 12*b* of rail 12. Likewise, tongue 12*a* may be slidably inserted into channel or retaining groove 13*b*. A locking pin 16 (not shown) attached to rail 12 engages holes 17 to secure rails 12 and 13 in position with respect to one another. Rails 14 and 15 have identical mirror image cross-sections as compared with rails 12 and 13, and are arranged in symmetric opposing fashion in FIG. 1** to provide a lateral retaining wall or vertical surface to prevent a wheeled dolly or hand truck from wandering from the load bearing support surface of each rail indicated at A.

Figure 4:
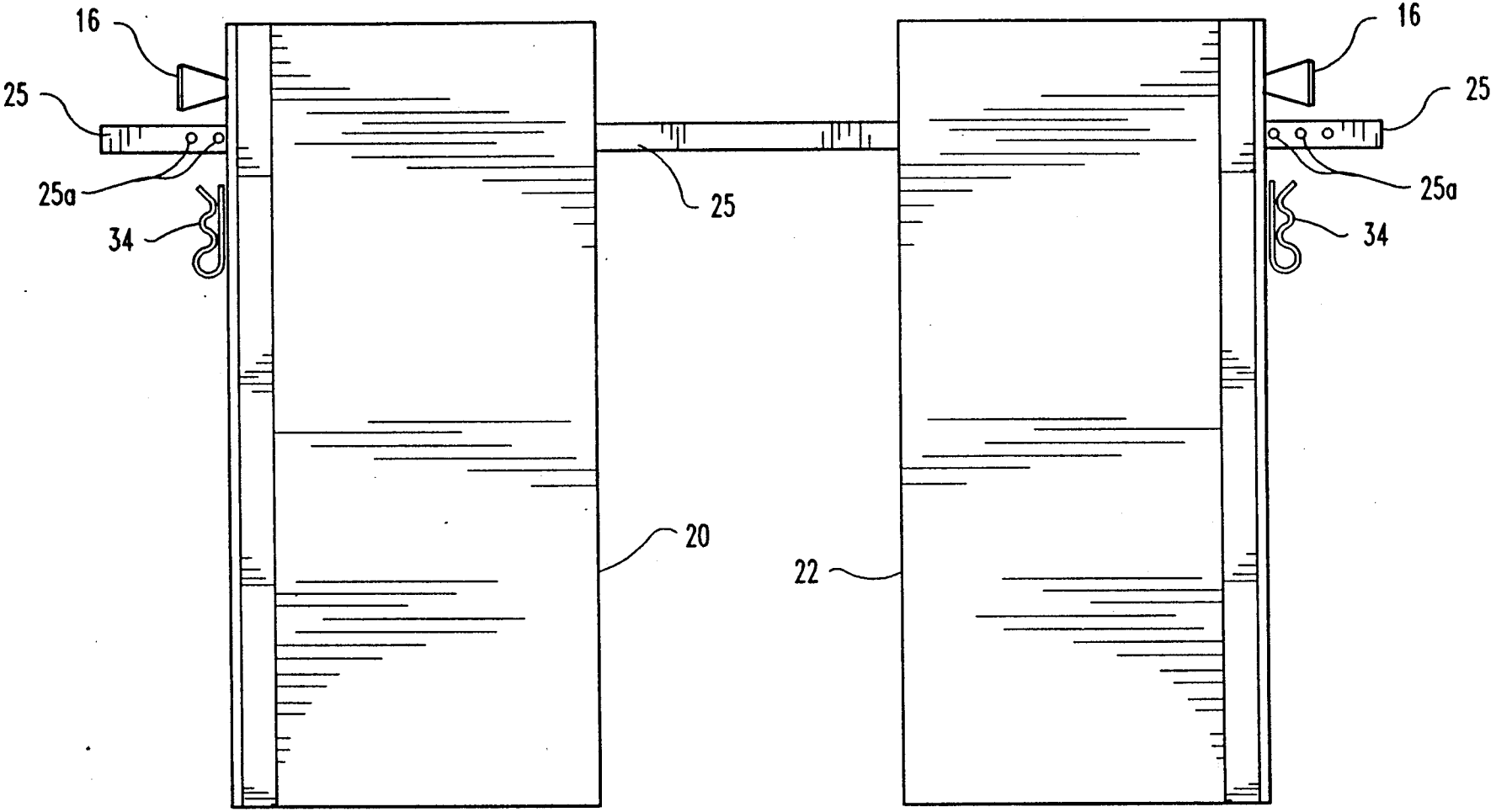
FIG. 4 is a plan view of the triangular supports and the rod used to establish a fixed distance separating the supports.

Referring now to FIG. 4, a plan view of triangular supports 20 and 22 with rod 25 establishing a predetermined fixed distance between the supports 20 and 22 is shown. Rod 25 is inserted through the tube (not shown) of each triangular support member 20 and 22 and cotter pins 34 are inserted into holes **25*a* of rod 25 to establish a fixed distance between supports 20 and 22. Also shown are locking pins 16 which secure the supports in position relative to the rails 12–15. The removable insertable rod 25 provides variable adjustment of the distance between supports 20 and 22, and thus determines the separation distance between the right rail assembly comprised of rails 12 and 13 and the left rail assembly comprised of rails 14 and 15**.

Referring now to FIG. 5, an enlarged partial side view of rail 15 is shown. It should be recognized that rail 13 is a mirror image of rail 15 and the following description of rail 15 is contemplated as providing sufficient description so that those skilled in the art are enabled to construct rail 13 as well as rail 15. Rail 15 includes a tongue **15*a*, a stop pin 18, a locking pin 16, an anti-skid pad 24 attached to the underside of plate 38, and a tube 36 attached to the distal end of plate 38. The lower support member 19, comprised of plate 38, anti-skid pad 24 and tube 36, is mechanically attached to rail 15 and provides a support bracing system to prevent the lower end of the stair track device from moving with respect to the stairway. It is contemplated that plate 38 may be hingedly or pivotally attached with a ratchetlike mechanism at location B to rail 15 to enable the stair track device 10 to accommodate a variety of rise versus run ratios of various stairways. However, for convenience and economic reasons, a rigid attachment of plate 38 to rail 15** as shown is suitable for most applications.

Rods 25 in FIGS. 4 and 5 are positioned as close as possible to the horizontal and vertical surfaces of the stairway 11 to prevent the rods from being trip hazards to persons who are negotiating the stairway in a normal fashion. Professional movers typically traverse a stairway many times while a stair track device is installed on the stairway, and elimination of trip hazards significantly improves concerns regarding footing on a stairway. Preferably, the rods 25 are disposed as close as possible to the recesses (11*a* of FIG. 1) defined by the horizontal and vertical surfaces of the stairway 11.

Referring now to FIG. 6, a partial cutaway view of locking pin 16 attached to rail 12 is shown. It should be understood that all locking pins 16 are identical in form and function to secure one rail section to an interlocking adjacent rail section, or secure a support 20 or 22 to a rail section 12–15. Locking pin 16 is comprised of knob 40, an internal pin 42 attached to knob 40 and a retaining tube 44 wherein spring 46 is disposed. Spring 46 is retained between edges 42*a* and 44*a* to provide a spring action mechanism with respect to pin 42 and knob 40. When knob 40 is mechanically moved away from rail 12, pin 42 is moved along with knob 40 so that the area indicated at C is no longer blocked or obscured by the pin end 42*b*. Thus, an adjacent rail may be inserted into the retaining groove 12*b* of rail 12 freely without obstruction. Upon appropriate positioning of a tongue inserted into the retaining groove 12*b*, knob 40 is released so that the pin end 42*b* mates with a corresponding hole 17 (see FIG. 3). It should also be understood that knob 40 may have a rotatable action so that knob 40 may be moved away from rail 12 and locked in an "outer" position to permanently maintain the position of pin end 42*b* in a retracted state, thus enabling convenient adjustment of a mating rail with respect to rail 12. Such locking pin mechanisms are well known in the art and other locking pin devices are contemplated as being substituted for the locking pin 16.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A stair track device for use with a stairway and comprising:

a first rail having an L-shaped cross-section, said first rail including a channel on one surface of said first rail and a tongue means on a second surface of said first rail for slidably engaging a corresponding mating channel of another rail;

a second rail having an L-shaped cross-section, said second rail including a channel on one surface of said first rail and a tongue means on a second surface of said first rail wherein said second rail slidably engages said channel of said first rail to provide a first longitudinally adjustable rail assembly;

a third rail having an L-shaped cross-section, said third rail including a channel on one surface of said first rail and a tongue means on a second surface of said first rail for slidably engaging a corresponding mating channel of another rail;

a fourth rail having an L-shaped cross-section, said fourth rail including a channel on one surface of said first rail and a tongue means on a second surface of said first rail wherein said fourth rail slidably engages said channel of said third rail to provide a second longitudinally adjustable rail assembly;

a first triangular support member removably attached to said first rail, said first support member situated near the top of the stairway;

a second triangular support member removably attached to said third rail, said second support member situated near the top of the stairway; and a first transverse stabilizer rod removably attached to said first and second triangular support members, said rod situated in close proximity to the surface of the stairway.

2. The stair track device of claim 1 wherein said first and second triangular support members include tongue means for slidably engaging said channel of said rails, said first and second triangular support members also including a channel sized to slidably receive said tongue means of said rails.

3. The stair track device of claim 2 including lower support members attached to said rail assemblies and disposed to engage the horizontal surface of the stairway.

4. The stair track device of claim 3 wherein said lower support members include anti-skip pads attached to the underside of said lower support members.

5. The stair track device of claim 4 including a second transverse stabilizer rod removably attached to said lower support members.

6. The stair track device of claim 5 wherein said first and second transverse stabilizer rods are disposed in the recess defined by the horizontal or vertical surfaces of the stairway.

7. The stair track device of claim 6 wherein said first, second, third and fourth rails include locking means for preventing longitudinal movement of said rail assemblies when said rail assemblies are extended to a desired telescoping length.

8. The stair track device of claim 2 wherein said first, second, third and fourth rails include locking means for preventing longitudinal movement of said rail assemblies when said rail assemblies are extended to a desired telescoping length.

9. The stair track device of claim 8 wherein said locking means includes holes in said rails and pins inserted through said holes.

10. The stair track device of claim 9 wherein said first and second longitudinally adjustable rail assemblies are arranged in symmetric opposing fashion on the stairway so that the L-shaped cross-section of each of said rails defines a lateral retaining wall.

11. The stair track device of claim 10 wherein said triangular supports include locking means for preventing longitudinal movement of said rail assemblies with respect to said triangular supports when said rail assemblies are removably attached to said first and second assemblies.

12. The stair track device of claim 11 including lower support members attached to said rail assemblies and disposed to engage the horizontal surface of the base of the stairway.

13. The stair track device of claim 12 wherein said lower support members include anti-skip pads attached to the underside thereof.

14. The stair track device of claim 13 wherein said triangular support members include anti-skid pads attached to the underside thereof.

15. The stair track device of claim 14 including a second transverse stabilizer rod removably attached to said lower support members.

16. The stair track device of claim 15 wherein said rails include stop pins disposed on said tongue means and which define the minimum length to which said rail assemblies may be adjusted.

17. A stair track device for use with a stairway and comprising:

a first rail having a channel on one surface of said first rail and a tongue means on a second surface of said first rail for slidably engaging a corresponding mating channel of another rail;

a second rail having a channel on one surface of said first rail and a tongue means on a second surface of said first rail wherein said second rail slidably engages said channel of said first rail to provide a first longitudinally adjustable rail assembly;

a third rail having a channel on one surface of said first rail and a tongue means on a second surface of said first rail for slidably engaging a corresponding mating channel of another rail;

a fourth rail having a channel on one surface of said first rail and a tongue means on a second surface of said first rail wherein said fourth rail slidably engages said channel of said third rail to provide a second longitudinally adjustable rail assembly;

a first support member removably attached to said first rail, said first support member situated near the top of the stairway;

a second support member removably attached to said third rail, said second support member situated near the top of the stairway; and a first transverse stabilizer rod removably attached to said first and second support members, said rod situated in close proximity to the surface of the stairway.

18. The stair track device of claim 17 wherein said first and second triangular support members include tongue means for slidably engaging said channel of said rails, said first and second support members having a triangular profile with the hypotenuse of the trangular support members having a channel sized to slidably receive said tongue means of said rails.

19. The stair track device of claim 18 including lower support members attached to one end of said rail assemblies and disposed to engage the horizontal surface of the stairway.

20. The stair track device of claim 19 wherein said lower support members include anti-skip pads attached to the underside of said lower support members.

* * * * *